United States Patent [19]

Abel

[11] Patent Number: 4,545,919

[45] Date of Patent: Oct. 8, 1985

[54] DETERGENT COMPOSITION FOR WASHING OFF DYEINGS OBTAINED WITH FIBRE-REACTIVE DYES AND WASHING PROCESS COMPRISING THE USE THEREOF

[75] Inventor: Heinz Abel, Reinach, Switzerland

[73] Assignee: Ciba-Geigy Corporation, Ardsley, N.Y.

[21] Appl. No.: 525,842

[22] Filed: Aug. 24, 1983

[30] Foreign Application Priority Data

Aug. 31, 1982 [CH] Switzerland ..... 5175/82
Mar. 23, 1983 [CH] Switzerland ..... 1573/83

[51] Int. Cl.[4] ..... C11D 1/44; C11D 3/14; C11D 7/02; D06L 3/00

[52] U.S. Cl. ..... 252/174.18; 8/102; 8/441; 252/99; 252/102; 252/140; 252/173; 252/174.24; 252/174.25; 252/540; 252/174.23

[58] Field of Search ..... 252/102, 140, 540, 173, 252/174.18, 174.23, 174.24, 174.25, 99, DIG. 2, DIG. 14; 8/441, 102

[56] References Cited

U.S. PATENT DOCUMENTS

| | | | |
|---|---|---|---|
| 4,018,720 | 4/1977 | Lengyel et al. | 252/DIG. 14 X |
| 4,071,377 | 1/1978 | Schwuger et al. | 252/99 X |
| 4,072,621 | 2/1978 | Rose | 252/DIG. 2 X |
| 4,072,622 | 2/1978 | Kühling et al. | 252/179 |
| 4,083,794 | 4/1978 | Lee et al. | 252/174.24 X |
| 4,264,480 | 4/1981 | Andree et al. | 252/174.25 X |
| 4,265,777 | 5/1981 | Boyer et al. | 252/174.25 X |
| 4,267,068 | 5/1981 | Diessel et al. | 252/174.25 X |
| 4,303,557 | 12/1981 | Rose | 252/527 |
| 4,405,483 | 9/1983 | Kuzel et al. | 252/DIG. 14 X |

FOREIGN PATENT DOCUMENTS

| | | |
|---|---|---|
| 0000215 | 1/1979 | European Pat. Off. . |
| 1584538 | 2/1981 | United Kingdom . |

OTHER PUBLICATIONS

Chemical Abstract, vol. 90, p. 82, 205646, Locanit WS-A New Soaping Auxiliary for Dying and Printing.

*Primary Examiner*—John E. Kittle
*Assistant Examiner*—Mukund J. Shah
*Attorney, Agent, or Firm*—Edward McC. Roberts; Kevin T. Mansfield

[57] ABSTRACT

The invention relates to an aqueous detergent composition comprising (A) an alkali aluminum silicate, (B) an anionic surfactant, (C) an aliphatic monoalcohol of 5 to 18 carbon atoms or a $C_8$–$C_{22}$fatty acid/alkanolamine reaction product or an adduct of said compounds with an alkylene oxide, or an adduct of a $C_8$–$C_{22}$fatty acid, a trihydric to hexahydric aliphatic alcohol or an unsubstituted or substituted phenol with an alkylene oxide, and (D) an aqueous solution or dispersion of a polymer which contains carboxyl groups.

This detergent composition is used for washing off prints or dyeings produced with reactive dyes on cellulosic fibre materials.

21 Claims, No Drawings

DETERGENT COMPOSITION FOR WASHING OFF DYEINGS OBTAINED WITH FIBRE-REACTIVE DYES AND WASHING PROCESS COMPRISING THE USE THEREOF

The present invention relates to an aqueous detergent composition which can be used for washing off prints or dyeings obtained with reactive dyes on cellulosic textile materials, and to a washing process which comprises the use thereof. The detergent composition is especially suitable if the washing off is effected with mineral-containing "hard" water.

The detergent composition of this invention comprises (A) an alkali aluminium silicate, (B) an anionic surfactant, (C) an aliphatic monoalcohol of 5 to 18 carbon atoms or a $C_8$–$C_{22}$ fatty acid/alkanolamine reaction product or the adducts thereof with alkylene oxide, or adducts of $C_8$–$C_{22}$ fatty acids, trihydric to hexahydric aliphatic alcohols or unsubstituted or substituted phenols with alkylene oxides, and (D) an aqueous solution or dispersion of polymers which contain carboxyl groups.

In addition to the above components (A), (B), (C) and (D), the detergent composition of this invention may also contain adjuvants and auxiliaries.

Components (A), (B), (C) and (D) may be present as individual compounds or as mixtures with each other.

The aqueous detergent composition preferably contains, based on the entire composition, (A) 20 to 60% by weight of an alkali aluminium silicate, (B) 0.5 to 20% by weight of an anionic surfactant, (C) 1 to 20% by weight of component (C), and (D) 2 to 30% by weight of the aqueous component (D).

Component (A), which constitutes the actual active ingredient of the detergent composition of the invention, is advantageously a finely particulate water-insoluble alkali aluminium silicate of the formula $$(Me_{2/n}O)_{Y_1} \cdot Al_2O_3 \cdot (SiO_2)_{Y_2} \quad (1)$$

wherein Me is an n-valent alkali metal ion, preferably the sodium ion, n is 1 or 2, $Y_1$ is a value from 0.7 to 1.5 and $Y_2$ is a value from 0.8 to 6, preferably from 1.3 to 4.

Such aluminium silicates conveniently have a particle size in the range from 1 to 12$\mu$, preferably from 2 to 8$\mu$. They usually contain from 100 to 200 mg of CaO per gram of anhydrous active ingredient.

The alkali aluminium silicates employed as component (A) may be prepared in simple manner synthetically, for example by reacting water-soluble silicates with water-soluble aluminates in the presence of water. To this end, aqueous solutions of the starting materials are mixed with each other or one component, in the solid state, is mixed with the other component which is in the form of an aqueous solution. The desired aluminium silicates are also obtained by mixing both components, in the solid state, in the presence of water. Alkali aluminium silicates can also be prepared from $Al(OH)_3$, $Al_2O_3$ or $SiO_2$ by reaction with solutions of alkali silicates or aluminates. Finally, such substances can also be obtained from the melt.

The alkali aluminium silicates prepared by precipitation or other processes and converted, in finely particulate state, into aqueous suspensions can be converted by heating to temperatures from 50° to 200° C. from the amorphous into the denatured or into the crystalline state. The amorphous or crystalline alkali aluminium silicate, which is present in aqueous suspension, can be separated from the residual aqueous solution by filtration and, if desired, dried in the temperature range from e.g. 50° to 800° C. In general, however, moist filter cakes or flowable suspensions of the alkali aluminium silicates are used.

The precipitation conditions can contribute to the formation of the small particle sizes of 1–12$\mu$ by subjecting the combined aluminate and silicate solutions—which may also be introduced simultaneously into the reactor—to strong shearing forces, for example by stirring the suspension vigorously. If crystallised alkali aluminium silicates are prepared—these are preferably employed in the practice of this invention—then the formation of larger penetrating crystals is prevented by slowly stirring the crystallising slurry.

An undesirable agglomeration of crystal particles may still occur, so that it is advisable to remove these secondary particles in suitable manner, e.g. by air classification. It is also possible to use alkali aluminium silicates which are obtained in coarser form and which have been ground to the desired particle size using e.g. mills and/or air classifiers or combinations thereof.

Further particulars on the nature of the alkali aluminium silicates employed as component (A), including the preparation thereof, are disclosed in German Offenlegungsschrift No. 27 14 954.

The anionic surfactants (B) are preferably acid derivatives of non-ionic or cationic alkylene oxide adducts, e.g. adducts of 2 to 100 moles of alkylene oxides, preferably of ethylene oxide and/or propylene oxide or also styrene oxide, with organic hydroxyl, carboxyl, amino and/or amido compounds containing aliphatic hydrocarbon radicals having a total of at least 4, preferably 12, carbon atoms, or mixtures of such compounds, which adducts contain acid ether groups or, preferably, acid ester groups of inorganic or organic acids. These acid ethers or esters can be in the form of the free acids or salts, e.g. alkali metal salts, alkaline earth metal salts, ammonium or amine salts.

These anionic surfactants are obtained by known methods, by addition of at least 2 moles, preferably of more than 2 moles, e.g. 10 to 100 moles, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexahydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having at least 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Very suitable anionic alkylene oxide polyadducts (B) are acid esters, or acid ester salts, of a polyadduct of 2 to 100 moles, preferably up to 50 moles, of ethylene oxide with 1 mole of a fatty alcohol containing 8 to 22 carbon atoms, or with 1 mole of a phenol which contains at least one benzyl group, one phenyl group or preferably one alkyl group containing at least 4 carbon atoms, e.g. benzylphenol, dibenzylphenol, dibenzyl(-nonyl)phenol, o-phenylphenol, butylphenol, tributylphenol, octylphenol, nonylphenol, dodecylphenol or pentadecylphenol, which acid esters may be used individually or in admixture.

Preferred alkylene oxide polyadducts (B) have the formula $$Y—O—(CH_2CH_2O)_m—X, \quad (2)$$

wherein Y is alkyl or alkenyl, each of 8 to 22 carbon atoms, alkylphenyl containing 4 to 16 carbon atoms in the alkyl moiety, or o-phenylphenyl, X is the acid radical of an inorganic oxygen-containing acid, e.g. sulfuric acid or phosphoric acid, or is also the radical of an organic acid, and m is 2 to 40, preferably 2 to 15. The alkyl moiety of alkylphenyl is preferably in the para-position, and can be butyl, hexyl, n-octyl, n-nonyl, p-tert-octyl, p-isononyl, decyl or dodecyl. Preferred alkyl radicals are those containing 8 to 12 carbon atoms, with octyl and nonyl being most preferred.

The fatty alcohols for obtaining the anionic surfactants of the formula (2) are e.g. those containing 8 to 22, preferably 8 to 18, carbon atoms, such as octyl, decyl, lauryl, tridecyl, myristyl, cetyl, stearyl, oleyl, arachidyl or behenyl alcohol.

The acid radical X is derived, for example, from a low molecular dicarboxylic acid, e.g. from maleic acid, succinic acid or sulfosuccinic acid, and is linked to the oxyethylene part of the molecule through an ester bridge. In particular, X is derived from an inorganic polybasic acid such as sulfuric acid or orthophosphoric acid. The acid radical X can be in the form of the free acid or in salt form, i.e. for example in the form of an alkali metal salt, ammonium salt or amine salt. Examples of such salts are: lithium, sodium, potassium, ammonium, trimethylamine, ethanolamine, diethanolamine or triethanolamine salts.

Particularly preferred anionic surfactants (B) are those of the formula

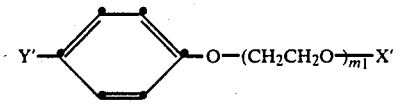

(3)

wherein Y' is octyl or nonyl, $m_1$ is 2 to 15, and X' is a radical derived from sulfuric acid or from o-phosphoric acid, which surfactants are in the form of free acids or sodium or ammonium salts. A particularly preferred anionic surfactant is the acid sulfuric acid ester of the adduct of 2 to 12 moles of ethylene oxide with 1 mole of p-nonylphenol.

The anionic alkylene polyadducts (B) can be used singly or in admixture for preparing the detergent composition of this invention.

The aliphatic monoalcohols employed as component (C) are e.g. those containing at least 5, preferably 8 to 18, carbon atoms. These alcohols may be saturated or unsaturated and branched or straight-chain, and they may be employed individually or in admixture. It is possible to use natural alcohols, e.g. amyl alcohol, lauryl alcohol, myristyl alcohol, cetyl alcohol, stearyl alcohol or oleyl alcohol, or synthetic alcohols, e.g. oxo alcohols such as, in particular, 2-ethylbutanol, 2-ethylhexanol, isooctyl alcohol, trimethylhexanol, trimethylnonyl alcohol, hexadecyl alcohol or alfols.

The alkylene oxide adducts obtained from the above water-insoluble monoalcohols, e.g. 1,2-propylene oxide adducts, e.g. those containing 1 to 15 moles of propylene oxide, but preferably the ethylene oxide adducts of these alcohols, can also be employed as component (C). Preferred ethylene oxide adducts are illustrated e.g. by the formula $$R—O—(CH_2CH_2O)_2—H \quad (4)$$

wherein R is a saturated or unsaturated aliphatic radical, preferably alkyl or alkenyl, each of 8 to 18 carbon atoms, and s is a value from 1 to 10, preferably 1 to 3.

Also suitable as component (C) are fatty acid/alkanolamine reaction products which are preferably derived from $C_8$–$C_{22}$ fatty acids and alkanolamines containing 2 or 3 carbon atoms in each alkanol moiety. The reaction products of $C_{12}$–$C_{18}$ fatty acids are preferred.

A suitable alkanolamine is e.g. ethanolamine, diethanolamine, propanolamine, isopropanolamine or diisopropanolamine. Dialkanolamines in particular diethanolamine, are preferred. The molar ratio of fatty acid to dialkanolamine may be 1:1 to 1:2. Examples of fatty acids are: decenoic acid, lauric acid, coconut fatty acid, myristic acid, palmitic acid, tallow fatty acid, oleic acid, ricinolic acid, linolic acid, linolenic acid, stearic acid, arachinic acid or behenic acid.

It is also possible to use the mixtures of these acids obtained by cleaving natural oils or fats. Mixtures of palmitic acid and stearic and, in particular, coconut fatty acid, are particularly preferred. These reaction products of component (C) and their preparation are disclosed e.g. in U.S. Pat. No. 2,089,212.

As component (C) it is also possible to use alkylene oxide adducts, especially ethylene oxide adducts, of the above mentioned fatty acid/alkanolamine reaction products, individual ethylene oxide units of which adducts can be replaced by substituted epoxides such as propylene oxide. The number of alkylene oxide groups in these glycol ethers can be 1 to 8 and, preferably, 1 to 4. Preferred adducts are those of 1 to 4 moles of ethylene oxide with 1 mole of the reaction product of 1 mole of coconut fatty acid, stearic acid and/or palmitic acid with 1 mole of diethanolamine.

Further reaction products suitable for use as component (C) are adducts of preferably 2 to 15 moles of alkylene oxide, e.g. ethylene oxide and/or propylene oxide, with unsubstituted or substituted phenols, trihydric to hexahydric aliphatic alcohols containing 3 to 9 carbon atoms, or with the fatty acids referred to above.

Examples of suitable unsubstituted or substituted phenols are phenol, o-phenylphenol or alkylphenols containing preferably altogether 4 to 16, most preferably 4 to 12, carbon atoms, in the alkyl moiety. Examples of these alkylphenols are: butylphenol, tributylphenol, octylphenol and, in particular, nonylphenol.

The trihydric to hexahydric alkanols contain preferably 3 to 6 carbon atoms and are in particular glycerol, trimethylolpropane, erythritol, mannitol, pentaerythritol and sorbitol. The trihydric to hexahydric alcohols are preferably reacted with ethylene oxide or most preferably with propylene oxide or with mixtures thereof.

The fatty acids contain preferably 8 to 22 carbon atoms and may be saturated or unsaturated, e.g. capric, lauric, myristic, palmitic or stearic acid, and decenoic, dodecenoic, tetradecenoic, hexadecenoic, oleic, linoleic, linolenic or, preferably, ricinolic acid.

Preferred components (C) consist of an aliphatic $C_8$–$C_{18}$ monoalcohol, a fatty acid/alkanolamine reaction product as specified above or, in particular, of a mixture of these substances. If desired, the mixture may also additionally contain an adduct of 5 to 12 moles of ethylene oxide with a $C_4$–$C_{12}$ alkylphenol.

The amounts in which component (C) is present in the detergent composition by itself or as a mixture of two, three or more components, varies from 1 to 20% by weight, preferably from 1 to 5% by weight, based on the entire composition.

The carboxylated polymers present in the detergent composition as component (D) are conveniently employed as 0.5 to 35%, preferably 0.5 to 5%, aqueous solutions or dispersions, based on the solution or dispersion. These polymers are preferably polymerised ethylenically unsaturated mono- or dicarboxylic acids containing 3 to 5 carbon atoms, e.g. polyacrylic acid or polymers of methacrylic acid, crotonic acid, itaconic acid, teraconic acid, maleic acid or the anhydride thereof, fumaric acid, citraconic acid or mesaconic acid, copolymers of olefins, e.g. ethylene or propylene, diketenes, acrylate, methacrylates or acrylamides and the above mentioned monomers, including acrylic acid, or copolymers of acrylic acid with methacrylic acid, methacrylonitrile or vinyl monomers, e.g. vinylphosphoric acid, copolymers of maleic acid and styrene, maleic acid and a vinyl ether or maleic acid and a vinyl ester, e.g. vinyl acetate. As component (D) it is also possible to use poly(N,N-biscarboxymethyl)vinylamine, poly(N,N-biscarboxymethyl)acrylamide, poly(N-carboxymethyl)ethylenediamine or polyhydroxycarboxylic acids.

The carboxylated polymer employed as component (D) in the detergent composition can also be used simultaneously as thickener. Provided they form suitable thickeners, the aqueous solutions or dispersions of the above polymers may be used as such, i.e. in acidic pH range, or converted into salts by addition of alkalies or ammonia and used in this form as thickener. Preferably they are adjusted to pH 6.5-7. In addition, they have a viscosity of advantageously 5000 centipoise, preferably of 8000 to 35,000 centipoise at 20° C. If desired, these thickeners may also be structurally viscous. The carboxylated polymer thickeners can have a molecular weight of ½ million to 6 million.

The solutions of the following polymers employed as component (D) are particularly useful thickeners:

(a) macromolecular copolymers of ethylene and maleic anhydride (molar ratio 1:1), especially those having a molecular weight from 0.1 to 2 million and whose 1.5% and 3% aqueous solutions, based on the copolymer, have a viscosity of 8000 to 100,000 centipoise, preferably up to 20,000 centipoise, at 20° C.;

(b) crosslinked carboxymethylene polymers with a molecular weight of 1 to 5 million, especially those whose 1.5 to 3% solutions, based on the copolymer, have a viscosity of 20,000 to 32,000 centipoise at 20° C.;

(c) polyacrylic acid or copolymers of acrylic acid and acrylamide, the molecular weight of which polymers may vary from half a million to 6 million. The copolymers preferably have a molar ratio of acrylic acid to acrylamide of 1:0.8 to 1:1.2. The preferred 1.5 to 3% aqueous solutions of these polymers (c) have a viscosity of 15,000 centipoise at 20° C.

The preferred component (D) in the detergent compositions of this invention is a partially hydrolysed polymaleic anhydride. This anhydride is normally in the form of a water-soluble salt and has a molecular weight of preferably 300 to 5000.

Polymaleic anhydride is a homopolymer of maleic anhydride and can be vary readily hydrolysed, for example by heating it in water, to form a polymer product which contains free carboxylic acid groups as well as in some cases still intact anhydride groups at a carbon main chain. The product is not a pure polymaleic acid and its exact constitution is not known. However, in this specification this polymeric product obtained by hydrolysis of polymaleic anhydride is referred to as hydrolysed polymaleic anhydride. It can be prepared by addition polymerisation of a starting monomer consisting substantially of maleic anhydride, under conditions of polymerisation, in the melt or by solution polymerization. It is preferred to polymerise maleic anhydride in an inert organic solvent, e.g. toluene or xylene, in the presence of a polymerisation catalyst, in particular a radical initiator, e.g. benzoyl peroxide, di-tertiary butyl peroxide or monobutyl hydroperoxide, in the temperature range up to 150° C., preferably from 120° C. to 145° C. The main chain of the primary polymer is substantially formed of nonhydrolysable bonds. After separation of unreacted monomer and by-products, the nonhydrolysed polymeric product is then hydrolysed with water or an aqueous base and then used in this form. If desired, it may also be used in non-hydrolysed form.

Decarboxylation of the polymer may occur during the polymerisation or the subsequent hydrolysis, so that the acid number of the hydrolysed polymaleic anhydride is lower than the theoretical value of 1143 mg KOH/g. However, such a decarboxylation does not take place to such an extent that the acid number falls below 350 mg KOH/g.

It is important that the molecular weight of the hydrolysed polymaleic anhydride is in the indicated lower range. It is preferred to use a polymaleic anhydride with a molecular weight which does not exceed 2000 and is preferably in the range from 350 to 1000.

Further particulars on hydrolysed polymaleic anhydride are disclosed e.g. in British patent specifications Nos. 1 369 429, 1 411 063, 1 491 978, and in Swiss patent specification No. 624 256.

By addition of a base to the hydrolysed polymaleic anhydride, some of its carboxyl groups are in the form of e.g. alkali metal or ammonium carboxylate groups. Particularly suitable alkali metal salts are the sodium or potassium salt, and ammonium salts are preferably ammonium ($NH_4^+$), alkylammonium or alkanolammonium salts, e.g. the trimethylammonium, monoethanolammonium, diethanolammonium or triethanolammonium salt. The sodium and ammonium ($NH_4^+$) salt are particularly suitable.

The hydrolysed polymaleic anhydride will normally be used as component (D) in the form of an aqueous 40 to 60% by weight solution, based on the solution. The detergent composition of the invention contains preferably 1.5 to 10% by weight of this aqueous solution, based on the entire composition. If hydrolysed polymaleic anhydride is used as component (D), the detergent composition preferably additionally contains a thickener to increase the stability. In this case, examples of suitable thickeners are polysaccharides, e.g. carboxymethyl cellulose, methyl cellulose, methyl hydroxyethyl cellulose, locust bean gum or starch ethers, as well as alginates or metal stearates, e.g. aluminium, calcium or zinc stearate, or also finely particulate silicic acid.

The amounts in which these additional constituents are present is generally from 0.1 to 5% by weight, preferably 0.3 to 2% by weight, based on the entire detergent composition.

In addition to components (A), (B), (C) and (D), the detergent composition may also contain, as component (E), a silicone oil or a mixture of silicone oils.

The silicone oils employed as component (E) are used in the compositions of this invention in order to produce a pronounced foam inhibiting effect. However, silicone oils can also further improve the wetting action of the composition. The silicone oils can be present in amounts of up to 15, e.g. 1 to 15, preferably up to 5% by weight, and also, if desired, of only up to 2% by weight, based on the detergent composition. Silicone oils will be understood as comprising organopolysiloxanes (optionally "tipped" with hydroxyl groups), e.g. polydimethyl siloxanes, polymethylphenyl siloxanes and polymethyl hydrogen siloxanes having average molecular weights of about 1000 to 100,000, preferably from 5000 to 40,000. Particularly suitable are alkylpolysiloxanes which have a viscosity of at least 0.7 centipose at 25° C. The alkyl moiety can contain 1 to 6 carbon atoms. Preferred polysiloxanes are e.g. the methyl siloxanes which have a viscosity of 30 to 15,000 centipoise, preferably of 100 to 1000 centipoise, at 25° C. Suitable methyl siloxanes may be illustrated by the formula

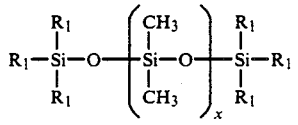

(5)

wherein $R^1$ is methyl or methoxy and x is an integer greater than 1, preferably 50 to 1200 or more. These are normally known commercial products which, in addition to the silicone oil, may contain other ingredients, e.g. colloidal silicic acid or emulsifiers based on polyethylene glycol. The silicone oils of higher molecular weight are preferred. It is preferred to use them in fairly small amounts to avoid e.g. self-effects (hydrophobic effects) of the silicone oils.

The amounts in which component (E) by itself or in admixture may be present in the detergent composition vary preferably from 0 to 5% by weight, most preferably from 0 to 3% by weight, based on the entire detergent composition.

Particularly preferred aqueous detergent compositions of this invention comprise at least the following components:

(Aa) a sodium aluminium silicate, (Bb) an anionic surfactant of the formula (3), (Cc) an aliphatic monoalcohol of 8 to 18 carbon atoms, a $C_8$–$C_{22}$ fatty acid/dialkanolamine reaction product or, preferably, a mixture thereof, and, as component (D)

($Dd_1$) an aqueous thickener solution of a polymerised ethylenically unsaturated mono- or dicarboxylic acid of 3 to 5 carbon atoms or of a copolymer of one of these acids and ethylene or acrylamide, in particular a copolymer of ethylene and maleic anhydride, or preferably ($Dd_2$) a hydrolysed polymaleic anhydride together with a thickener, e.g. a polysaccharide.

The detergent composition of the invention can be prepared by simple stirring of the components (A), (B), (C) and (D) and optionally (E) and/or thickener, in water, to give homogeneous clear mixtures which have very good stability at room temperature and are free from sedimentation.

These compositions preferably comprise, in each case based on the mixture, 35 to 50% by weight of component (A),
0.5 to 10% by weight of component (B),
1 to 15% by weight of component (C),
2 to 20% by weight of aqueous component (D), preferably in the form of a 1.5 to 30% aqueous solution, based on the polymer,
0 to 3% by weight of component (E),
0 to 2% by weight of a thickener
and at least
25% by weight of water.

If desired, such compositions may additionally contain neopentyl glycol, benzyl alcohol, furfuryl alcohol, ethyl acetate, diethyl malonate, diethyl succinate, diethyl adipate, tetralin, decalin, alkylbenzenes and, in particular, paraffin oils, as well as fatty amine/alkylene oxide adducts.

The detergent compositions of this invention are used in particular for washing off dyeings or prints on cellulose fibres or blends of cellulose and synthetic organic material, e.g. linear polyesters or modified cellulose (cellulose acetates). Suitable cellulosic material is that from natural or regenerated cellulose, e.g. hemp, linen, jute, viscose silk, viscose rayon or, in particular, cotton, and the polyester component, if present, is dyed before or after the cellulose. By dyeings and prints are meant in this context the dyeings and prints produced by any methods with reactive dyes, and the application of the detergent compositions is effected as an aftertreatment.

The dyed material may be in any stage of processing, e.g. as loose material (flocks), as folded prestretched staple slivers, or as filaments, yarns, and especially as wovens or knits. By reactive dyes are meant the conventional anionic dyes which form a chemical bond with cellulose, e.g. the dyes listed as "Reactive Dyes" in the Colour Index, 3rd Edition (1971), Vol. 3, on pages 3391–3562.

The detergent compositions of this invention make it possible to carry out with good success the customary washing operations in connection with prints or dyeings produced with the above mentioned reactive dyes also with the hard water (process water) directly available from the mains. The water hardness is thereby eliminated without the usual addition of electrolytes, ion exchangers and/or chelating agents and, in particular, of phosphorus compounds, e.g. phosphonic acids or inorganic phosphates, the use of which has recently been increasingly restricted by environmental and legislative demands for phosphorus-free products.

The invention further relates to a process for washing off prints or dyeings produced with reactive dyes on cellulosic textile materials, which process comprises the use of the detergent compositions of this invention. This process comprises treating the printed or dyed textiles, in the temperature range from 60° to 100° C., in and aqueous wash liquor which contains a detergent composition of the invention, preferably in an amount from 1 to 10 g/l. The textiles are then removed from the wash liquor and rinsed with fresh water until the constituents of the wash liquor have been completely removed. The white ground of the prints obtained is not stained, and the dyeings obtained by the exhaust process have the desired wetfastness properties, in particular washfastness.

In the following Preparatory Method and Examples, parts and percentages are by weight.

The following adducts are examples of the anionic surfactants and alkylene oxide adducts employed as components (B) and (D):

B. Anionic surfactants $B_1$ the ammonium salt of the acid sulfuric acid ester of the adduct of 2 moles of ethylene oxide and 1 mole of alfol (1014);

$B_2$ the ammonium salt of the acid sulfuric acid ester of the adduct of 2 moles of ethylene oxide and 1 mole of stearyl alcohol;

$B_3$ the ammonium salt of the acid sulfuric acid ester of the adduct of 3 moles of ethylene oxide and 1 mole of 2-ethylhexanol;

$B_4$ the ammonium salt of the acid sulfuric acid ester of the adduct of 15 moles of ethylene oxide and 1 mole of stearyl alcohol;

$B_5$ the ammonium salt of the acid sulfuric acid ester of the adduct of 3 moles of ethylene oxide and 1 mole of tridecyl alcohol;

$B_6$ the ammonium salt of the acid sulfuric acid ester of the adduct of 4 moles of ethylene oxide and 1 mole of hydroabietyl alcohol;

$B_7$ the ammonium salt of the acid sulfuric acid ester of the adduct of 3 moles of ethylene oxide and 1 mole of alfol (2022);

$B_8$ the ammonium salt of the acid sulfuric acid ester of the adduct of 3 moles of ethylene oxide and 1 mole of lauryl alcohol;

$B_9$ the di-($\beta$-hydroxyethyl)amine salt of the acid sulfuric acid ester of the adduct of 3 moles of ethylene oxide and 1 mole of lauryl alcohol;

$B_{10}$ the sodium salt of the acid sulfuric acid ester of the adduct of 2 moles of ethylene oxide and 1 mole of lauryl alcohol;

$B_{11}$ the sodium salt of the acid sulfuric acid ester of the adduct of 3 moles of ethylene oxide and 1 mole of lauryl alcohol;

$B_{12}$ the acid phosphoric acid ester of the adduct of 5 moles of ethylene oxide and 1 mole of 2-ethyl-n-hexanol;

$B_{13}$ the ammonium salt of the acid sulfuric acid ester of the adduct of 3 moles of ethylene oxide and 1 mole of butylphenol;

$B_{14}$ the ammonium salt of the acid sulfuric acid ester of the adduct of 5 moles of ethylene oxide and 1 mole of tributylphenol;

$B_{15}$ the ammonium salt of the acid sulfuric acid ester of the adduct of 2 moles of ethylene oxide and 1 mole of nonylphenol;

$B_{16}$ the ammonium salt of the acid sulfuric acid ester of the adduct of 10 moles of propylene oxide and 10 moles of ethylene oxide and 1 mole of nonylphenol;

$B_{17}$ the ammonium salt of the acid sulfuric acid ester of the adduct of 35 moles of ethylene oxide and 1 mole of nonylphenol;

$B_{18}$ the ammonium salt of the acid sulfuric acid ester of the adduct of 50 moles of ethylene oxide and 1 mole of nonylphenol;

$B_{19}$ the ammonium salt of the acid sulfuric acid ester of the adduct of 15 moles of propylene oxide and 1 mole of nonylphenol;

$B_{20}$ the ammonium salt of the acid sulfuric acid ester of the adduct of 6 moles of ethylene oxide and 1 mole of dodecylphenol;

$B_{21}$ the ammonium salt of the acid sulfuric acid ester of the adduct of 6 moles of ethylene oxide and 1 mole of pentadecylphenol;

$B_{22}$ the ammonium salt of the acid sulfuric acid ester of the adduct of 8 moles of ethylene oxide and 1 mole of o-phenylphenol;

$B_{23}$ the sodium salt of the acid maleic acid ester of the adduct of 2 moles of ethylene oxide and 1 mole of p-nonylphenol;

$B_{24}$ the sodium salt of the acid monosulfosuccinic acid ester of the adduct of 2 moles of ethylene oxide and mole of p-nonylphenol;

$B_{25}$ the ammonium salt of the acid phosphoric acid ester of the adduct of 2 moles of ethylene oxide and 1 mole of nonylphenol;

$B_{26}$ the sodium salt of the acid sulfuric acid ester of the adduct of 12 moles of ethylene oxide and 1 mole of dibenzylphenol;

$B_{27}$ the sodium salt of the acid sulfuric acid ester of the adduct of 15 moles of ethylene oxide and 1 mole of dibenzyl-(nonyl)-phenol;

$B_{28}$ the acid phosphoric acid ester of the adduct of 10 moles of ethylene oxide and 1 mole of p-nonylphenol;

$B_{29}$ the ammonium salt of the acid sulfuric acid ester of the adduct of 15 moles of ethylene oxide and 1 mole of stearic acid $\beta$-hydroxyethylamide;

$B_{30}$ the ammonium salt of the acid sulfuric acid ester of the adduct of 3 moles of ethylene oxide and 1 mole of lauryl alcohol;

$B_{31}$ the ammonium salt of the acid disulfuric acid ester of the adduct of 8 moles of ethylene oxide and 1 mole of tallow fatty amine;

$B_{32}$ the ammonium salt of the acid disulfuric acid ester of the adduct of 3 moles of propylene oxide and 5 moles of ethylene oxide and 1 mol of tallow fatty amine;

$B_{33}$ the ammonium salt of the acid disulfuric acid ester of the adduct of 8 moles of ethylene oxide and 1 mole of tallow fatty amine;

$B_{34}$ the ammonium salt of the acid disulfuric acid ester of the adduct of 1 mol of styrene oxide and 8 moles of ethylene oxide and 1 mol of dodecylamine;

$B_{35}$ the sodium salt of the acid sulfosuccinic acid hemiester of the adduct of 8 moles of ethylene oxide and 1 mole of tallow fatty amine;

$B_{36}$ the ammonium salt of the acid disulfuric acid ester of the adduct of 2 moles of ethylene oxide and 1 mole of stearylamine;

$B_{37}$ a 1:2 mixture of the mono- and diphosphoric acid ester of the adduct of 8 moles of ethylene oxide and 1 mole of dodecylamine;

$B_{38}$ a 1:2 mixture of the mono- and diphosphoric acid ester of the adduct of 4 moles of ethylene oxide and 1 mole of laurylamine.

C. Alkylene oxide adducts used as component (C):

$C_1$ the polyadduct of 6 moles of ethylene oxide and 1 mole of 2-ethyl-hexanol;

$C_2$ the polyadduct of 5 moles of ethylene oxide and 1 mole of 2-ethylhexanol;

$C_3$ the polyadduct of 15 moles of ethylene oxide and 1 mole of stearyl alcohol;

$C_4$ the polyadduct of 3 moles of ethylene oxide and 1 mole of alfol (8–10);

$C_5$ the polyadduct of 5 moles of ethylene oxide and 1 mole of hexadecyl alcohol;

$C_6$ the polyadduct of 15 moles of ethylene oxide and 1 mole of oleyl alcohol;

$C_7$ the polyadduct of 6 moles of ethylene oxide and 2 moles of butylphenol;

$C_8$ the polyadduct of 4 moles of ethylene oxide and 2 moles of p-cresol;

$C_9$ the polyadduct of 5 moles of ethylene oxide and 1 mole of tributylphenol;

$C_{10}$ the polyadduct of 8 moles of ethylene oxide and 1 mole of octylphenol;

$C_{11}$ the polyadduct of 9 moles of ethylene oxide and 1 mole of nonylphenol;

$C_{12}$ the polyadduct of 1O moles of ethylene oxide and 1 mole of nonylphenol;

$C_{13}$ the polyadduct of 10 moles of ethylene oxide and 10 moles of propylene oxide and 1 mole of nonylphenol;

$C_{14}$ the polyadduct of 10 moles of ethylene oxide and 1 mole of oleyl alcohol;

$C_{15}$ the polyadduct of 12 moles of ethylene oxide and 1 mole of oleic acid;

$C_{16}$ the polyadduct of 8 moles of ethylene oxide and 1 mole of o-phenylphenol;

$C_{17}$ the polyadduct of 5 moles of ethylene oxide and 5 moles of propylene oxide with 1 mole of alfol 12-14;

$C_{18}$ the polyadduct of 15 moles of ethylene oxide and 1 mole of castor oil;

$C_{19}$ the polyadduct of 8 moles of propylene oxide and 1 mole of pentaerythritol;

$C_{20}$ the polyadduct of 15 moles of ethylene oxide and 15 moles of propylene oxide with 1 mole of glycerol;

$C_{21}$ the polyadduct of 7 moles of ethylene oxide and 1 mole of $C_9$–$C_{11}$oxo alcohol;

$C_{22}$ the polyadduct of 15 moles of ethylene oxide and 1 mole of p-nonylphenol;

$C_{23}$ the polyadduct of 2 moles of ethylene oxide and 1 mole of coconut fatty acid (N,N-bis-$\beta$-hydroxyethyl-)amide;

$C_{24}$ the polyadduct of 5 moles of ethylene oxide and 1 mole of p-nonylphenol;

$C_{25}$ the polyadduct of 15 moles of propylene oxide and 1 mole of glycerol.

Preparatory Method A

The hydrolysed polymaleic anhydride used as component (D) is prepared as follows:

100 g of maleic anhydride and 100 g of xylene are heated to 120° C. and a solution of 20 g of di-tert-butyl peroxide in 50 g of xylene is added over 15 minutes. The temperature of the reaction mixture is raised to 130° C. and maintained for 5 hours. Both heating and stirring are discontinued and the polymer is allowed to separate from the xylene layer. The reaction mixture is cooled to 85° C. and the lower polymer layer is then separated from the upper xylene layer. Yield: 81 g of polymer.

The polymer is diluted with 15 g of 2-butanone or 1,4-dioxan and purified further as follows. The polymer is precipitated by adding the polymer solution to 430 g of toluene in a rapid homogeniser. The precipitate is isolated by filtration and dried in vacuo at 80° C., affording 78 g of powdered polymer. The polymaleic anhydride so obtained has a molecular weight of 580 (measured in 2-butanone by a vapour pressure osmometer).

20 g of the polymaleic anhydride are heated in 20 g of water for 20 minutes at 90° C., after which the resultant solution is cooled to 30° C. and filtered. A solution having a solid content of 53% is obtained. Potentiometric titration of the hydrolysed polymer against potassium hydroxide gives an acid value of 560 mg KOH/g.

Then 4.5 g of a 25% aqueous ammonia solution are added to the solution of the hydrolysed polymaleic anhydride, followed by the addition of sufficient water to give a 50% aqueous solution of the hydrolysed polymaleic anhydride partly in the form of the ammonium salt.

EXAMPLE 1

A stable homogeneous detergent composition is prepared by stirring the following constituents at room temperature:

| Percentages | Constituents |
|---|---|
| 45% | of sodium aluminium silicate, |
| 2% | of the anionic surfactant $B_{15}$, |
| 1% | of 2-ethyl-1-hexanol, |
| 0.5% | of silicone oil, |
| 3% | of a coconut fatty acid/diethanolamine reaction product (1:2), |
| 12% | of a 2% aqueous solution of the copolymer of ethylene and maleic anhydride (molar ratio 1:1, mol. wt. <500,000, viscosity: 68,000 centipoise), |
| 36.5% | of water. |

EXAMPLE 2

A stable homogeneous detergent composition is prepared by stirring the following constituents at room temperature:

| Percentages | Constiuents |
|---|---|
| 45% | of sodium aluminium silicate, |
| 2% | of the anionic surfactant $B_{15}$, |
| 1% | of 2-ethyl-1-hexanol, |
| 3% | of a coconut fatty acid/diethanolamine reaction product (1:2), |
| 3% | of a hydrolysed polymaleic anhydride (prepared according to Method A), |
| 0.6% | of a polysaccharide thickener, e.g. Kelzan ®, |
| 45.4% | of water. |

EXAMPLE 3

A stable homogeneous detergent composition is prepared by stirring the following constituents at room temperature:

| Percentages | Constituents |
|---|---|
| 40% | of sodium aluminium silicate, |
| 5% | of the anionic surfactant $B_{11}$, |
| 3% | of 2-ethyl-1-hexanol, |
| 4% | of a coconut fatty acid/diethanolamine reaction product (1:2), |
| 2% | of a hydrolysed polymaleic anhydride (prepared according to Method A), |
| 0.6% | of carboxymethyl cellulose, |
| 45.4% | of water. |

EXAMPLE 4

A stable homogeneous detergent composition is prepared by stirring the following constituents at room temperature:

| Percentages | Constituents |
|---|---|
| 35% | of sodium aluminium silicate, |
| 2% | of the anionic surfactant $B_{15}$, |
| 1% | of 2-ethyl-1-hexanol, |
| 3% | of a coconut fatty acid/diethanolamine reaction product (1:2), |
| 10% | of the surfactant $C_6$, |
| 12% | of a 2% aqueous solution of the copolymer of ethylene and maleic anhydride (molar ratio 1:1, mol. wt. 500.000, viscosity 68.000 centipoise), |
| 0.5% | of silicone oil, |
| 36.5% | of water. |

EXAMPLE 5

A stable detergent composition is prepared by stirring the following constituents at room temperature:

| Percentages | Constituents |
|---|---|
| 43% | of sodium aluminium silicate, |
| 5% | of the anionic surfactant $B_{22}$, |
| 2% | of 2-ethyl-1-hexanol, |
| 2% | of a coconut fatty acid/diethanolamine reaction product (1:2) |
| 3% | of a copolymer of maleic acid and styrene according to German Auslegeschrift 2 444 823, |
| 0.6% | of a polysaccharide thickener, e.g. Kelzan ®, |
| 44.4% | of water. |

EXAMPLE 6

A stable homogeneous detergent composition is prepared by stirring the following constituents at room temperature:

| Percentages | Constituents |
|---|---|
| 40% | of sodium aluminium silicate |
| 2% | of the anionic surfactant $B_{15}$, |
| 1% | of 2-ethyl-1-hexanol, |
| 6% | of the surfactant $C_{13}$, |
| 2% | of a hydrolysed polymaleic anhydride (prepared according to Method A), |
| 0.5% | of silicone oil, |
| 0.6% | of a polysaccharide thickener, |
| 47.9% | of water. |

EXAMPLE 7

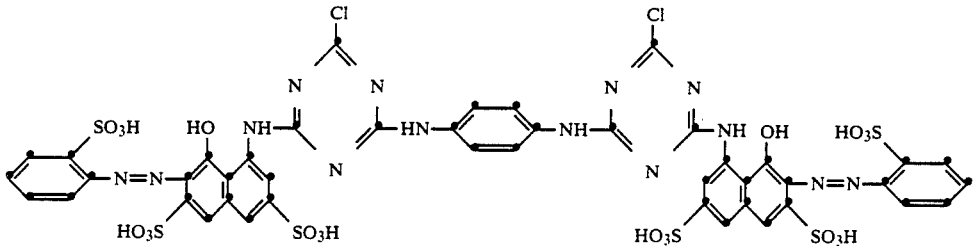

(102)

(A) Bleached cotton terry cloth is printed on a roller printing machine with 1 kg of a printing paste of the following composition 400 g of a 5% alginate thickener
100 g of urea
50 g of a dye of the formula

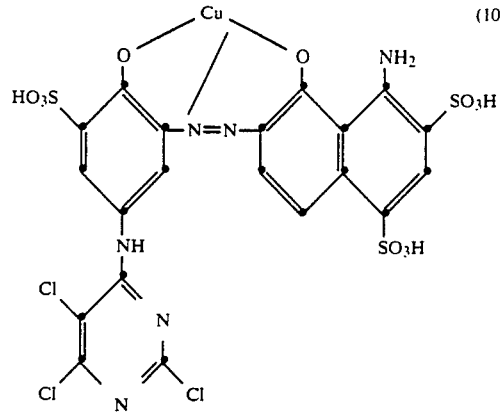

(101)

10 g of sodium m-nitrobenzenesulfonate
60 g of 30% sodium carbonate solution and 380 g of water so as to give 3 cm printed swatches together with 3 cm unprinted swatches. The goods are then dried and steamed for 8 minutes at 101° C.

The goods are then rolled up and used for the following test:

(B) 3 wash liquors, each of 150 ml, are heated to boiling temperature:

1. water of 20° hardness (dH) (German hardness)
2. water of 20° hardness (dH) +4 ml/l of the composition of Example 1
3. water of 20° hardness (dH) +8 ml/l of the composition of Example 1.

Three of the strips printed as in (A) are treated in succession for 5 minutes at boiling temperature in each of these wash liquors at a liquor ratio of 1:60, rinsed in cold water and dried in the air.

Treatment with wash liquors 2 and 3 gives cotton fabric which is not stained on the non-printed areas. On the other hand, the white ground of the print treated with wash liquor 1 is badly stained.

Fabric which is not stained on the non-printed areas is also obtained by using the same amount of one of the compositions of Examples 2 to 6 instead of the composition of Example 1 in wash liquors 2 and 3.

EXAMPLE 8

(A) 10 kg of bleached and mercerised cotton tricot are wetted in a closed winch beck in 400 liters of water to which are added 400 g of a dye of the formula 32 kg of sodium chloride and 800 g of sodium-nitrobenzene sulfonate. The dye liquor is then heated to 95° C. and subsequently kept for 30 minutes at 85° C. To the dye bath are then added 8 kg of sodium carbonate and 1.2 liters of 30% sodium hydroxide solution and the tricot is dyed for another 60 minutes at 85° C. The liquor is then cooled and the dyed goods are rinsed and dried.

(B) Cotton tricot swatches dyed as described in (A) are each treated individually in an Ahiba dyeing machine for 10 minutes at boiling temperature with the following three wash liquors at a liquor ratio of 1:50:

1. water of 20° dH hardness
2. water of 20° dH hardness + 4 ml/l of the composition of Example 1.
3. water of 20° dH hardness + 8 ml/l of the composition of Example 1.

The individual samples are then rinsed together for 10 minutes in cold permutite water. The treated dyed samples are spin-dried to 100% water absorption and tested for fastness to wet pressing in accordance with SNV Standard 19832. This is done by wetting a white cotton swatch in distilled water and spin-drying it to 100% water absorption. The moist dyed sample is placed on a dry white cotton swatch and covered with the moist white swatch. The samples are then pressed together for 2 minutes in an ironing press heated to 180° C. The white prewetted adjacent fabric is then assessed for its fastness to pressing.

The dyed swatches treated with wash liquors 2 and 3 do not stain the white swatch in the pressing fastness test, but the swatch treated with wash liquor 1 stains the white cotton severely.

Swatches which are fast to pressing are also obtained by using the same amount of one of the compositions of Examples 2 to 6 instead of the composition of Example 1 in wash liquors 2 and 3.

What is claimed is:

1. An aqueous detergent composition comprising (A) 20 to 60% by weight of an alkali aluminum silicate, (B) 0.5 to 20% by weight of an anionic alkylene oxide polyadduct of the formula $$Y—O—(CH_2CH_2O)_m—X$$

wherein Y is alkyl or alkenyl, each of 8 to 22 carbon atoms, alkylphenyl containing 4 to 16 carbon atoms in the alkyl moiety, or o-phenylphenyl, m is 2 to 40, and X is the acid radical of an inorganic oxygen-containing acid, or is the radical of an organic acid, said acid radical X being in the form of the free acid or its salt, (C) 1 to 20% by weight of an aliphatic monoalcohol of 5 to 18 carbon atoms or a $C_8$–$C_{22}$ fatty acid/alkanolamine reaction product or an adduct of said compounds with an alkylene oxide, or an adduct of $C_8$–$C_{22}$ fatty acid, a trihydric to hexahydric aliphatic alcohol or an unsubstituted or substituted phenol with an alkylene oxide, and (D) 2 to 30% by weight of an aqueous solution or dispersion of a polymer which contains carboxyl groups, in the substantial absence of chelating phosphorous compounds, electrolytes, ion exchangers and/or other chelating agents.

2. A detergent composition according to claim 1, which additionally comprises a silicone oil as component (E).

3. A detergent composition according to claim 1, wherein component (A) is a water-insoluble alkali aluminum silicate of the formula $$(Me_{2/n}O)_{Y_1} \cdot Al_2O_3 \cdot (SiO_2)_{Y_2} \quad (1)$$

wherein Me is an n-valent alkali metal ion, n is 1 or 2, $Y_1$ is a value from 0.7 to 1.5 and $Y_2$ is a value from 0.8 to 6.

4. A detergent composition according to claim 1, wherein component (B) is an anionic surfactant of the formula

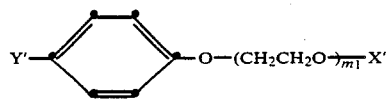

(3)

wherein Y' is octyl or nonyl, $m_1$ is 2 to 15, and X' is a radical derived from sulfuric acid or from o-phosphoric acid, which surfactant is in the form of the free acid or of the sodium or ammonium salt.

5. A detergent composition according to claim 1, wherein component (C) is an aliphatic monoalcohol of 8 to 18 carbon atoms, a $C_8$–$C_{22}$fatty acid/alkanolamine reaction product, or a mixture thereof.

6. A detergent composition according to claim 1, wherein component (D) is a 0.5 to 35% aqueous solution or dispersion of a polymerised ethylenically unsaturated mono- or dicarboxylic acid of 3 to 5 carbon atoms or of a copolymer of an olefin, an acrylate or acrylamide and one of the above acids, based on the polymer.

7. A detergent composition according to claim 1, which contains component (D) as thickener.

8. A detergent composition according to claim 8, wherein component (D) is a 1.5 to 3% aqueous solution of a macromolecular copolymer of ethylene and maleic anhydride in the molar ratio of 1:1, based on the copolymer.

9. A detergent composition according to claim 1, wherein the polymer of component (D) is a hydrolysed polymaleic anhydride.

10. A detergent composition according to claim 9, wherein the hydrolysed polymaleic anhydride is in the form of an alkali metal salt, ammonium salt, alkylammonium salt or alkanolammonium salt.

11. A detergent composition according to claim 9, which contains the hydrolysed polymaleic anhydride in combination with a polysaccharide as thickener.

12. A detergent composition according to claim 1 which comprises (Aa) a sodium aluminium silicate, (Bb) an anionic surfactant of the formula (3),

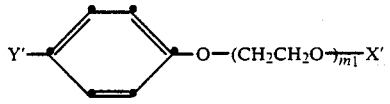

wherein Y' is octyl or nonyl, $m_1$ is a value from 2 to 15 and X' is an acid radical derived from sulfuric acid or o-phosphoric acid, (Cc) an aliphatic monoalcohol of 8 to 18 carbon atoms, a $C_8$–$C_{22}$fatty acid/dialkanolamine reaction product or a mixture thereof, and, ($Dd_1$) an aqueous thickener solution of a polymerised ethylenically unsaturated mono- or dicarboxylic acid of 3 to 5 carbon atoms or of a copolymer of one of these acids and ethylene or acrylamide, or ($Dd_2$) a hydrolysed polymaleic anhydride together with a thickener.

13. A detergent composition according to claim 1, wherein component (C) is an aliphatic monoalcohol of 8 to 18 carbon atoms.

14. A detergent composition according to claim 1, wherein component (C) is an adduct of 1 mole of an aliphatic monoalcohol having 8 to 18 carbon atoms with 1 to 15 moles of ethylene oxide, propylene oxide or a mixture of said oxides.

15. A detergent composition according to claim 1, wherein component (C) is a reaction product of a $C_8$–$C_{22}$fatty acid with a monoalkanolamine or dialkanolamine containing 2 or 3 carbon atoms in each alkanol moiety.

16. A detergent composition according to claim 1, wherein component (C) is an adduct of 1 mole of a $C_8$–$C_{22}$fatty acid/mono- or di-$C_2$-$C_3$-alkanolamine reaction product with 1 to 8 moles of ethylene oxide, propylene oxide or a mixture thereof.

17. A detergent composition according to claim 1, wherein component (C) is an adduct of 1 mole of o-phenylphenol or an alkylphenol having 4 to 16 carbon atoms in the alkyl moiety with 2 to 15 moles of ethylene oxide, propylene oxide or a mixture thereof.

18. A detergent composition according to claim 1, wherein component (C) is an adduct of 1 mole of a trihydric to hexahydric aliphatic alcohol containing 3 to 9 carbon atoms with 2 to 15 moles of ethylene oxide, propylene oxide or a mixture thereof.

19. A detergent composition according to claim 1, wherein component (C) is an adduct of 1 mole of a $C_8$–$C_{22}$ fatty acid with 2 to 15 moles of ethylene oxide, propylene oxide or a mixture thereof.

20. A process for washing off prints or dyeings produced with reactive dyes on cellulosic textile materials, in the substantial absence of chelating phosphorous compounds electrolytes, ion exchangers and/or other chelating agents, which process comprises treating the printed or dyed textile materials, at a temperature in the range of 60° to 100° C., with an aqueous wash liquor which contains a detergent composition of claim 1.

21. A process according to claim 20, wherein the wash liquor contains the detergent composition in an amount from 1 to 10 g/l.

* * * * *